US011022341B2

(12) United States Patent
Choi

(10) Patent No.: US 11,022,341 B2
(45) Date of Patent: Jun. 1, 2021

(54) STORAGE TYPE ELECTRIC WATER HEATER WITH HOT AIR GENERATING FUNCTION

(71) Applicant: Young-Hwan Choi, Seoul (KR)

(72) Inventor: Young-Hwan Choi, Seoul (KR)

( * ) Notice: Subject to any disclaimer, the term of this patent is extended or adjusted under 35 U.S.C. 154(b) by 111 days.

(21) Appl. No.: 16/448,617

(22) Filed: Jun. 21, 2019

(65) Prior Publication Data

US 2019/0309990 A1 Oct. 10, 2019

Related U.S. Application Data

(63) Continuation of application No. PCT/KR2018/009734, filed on Aug. 23, 2018.

(30) Foreign Application Priority Data

Oct. 16, 2017 (KR) ..... 10-2017-0133939

(51) Int. Cl.

| | |
|---|---|
| ***F24H 6/00*** | (2006.01) |
| ***F24H 7/02*** | (2006.01) |
| ***F24H 9/02*** | (2006.01) |
| ***F24H 9/18*** | (2006.01) |
| ***F24H 9/00*** | (2006.01) |
| ***F24H 3/08*** | (2006.01) |

(52) U.S. Cl.

CPC ..... *F24H 6/00* (2013.01); *F24H 3/08* (2013.01); *F24H 7/02* (2013.01); *F24H 9/00* (2013.01); *F24H 9/02* (2013.01); *F24H 9/18* (2013.01)

(58) Field of Classification Search

None

See application file for complete search history.

(56) References Cited

U.S. PATENT DOCUMENTS 2,643,323 A * 6/1953 Carlson ..... F24H 6/00 219/472
3,171,387 A * 3/1965 Muller ..... F24H 1/52 122/33
3,237,608 A * 3/1966 Brandl ..... F24H 1/0009 122/33
3,404,674 A * 10/1968 Albert ..... F24H 1/205 126/101
3,763,848 A * 10/1973 Williams ..... F24C 3/14 126/101

(Continued)

FOREIGN PATENT DOCUMENTS

JP 2005-337695 A 12/2005
KR 10-2005-0092066 A 9/2005

(Continued)

OTHER PUBLICATIONS

"KR_101758012_B1_H—MachineTranslation.pdf", machine translation, EPO.org, Nov. 22, 2020. (Year: 2020).*

(Continued)

*Primary Examiner* — Steven B. McAllister
*Assistant Examiner* — Daniel E. Namay
(74) *Attorney, Agent, or Firm* — Studebaker & Brackett PC

(57) ABSTRACT

A storage type electric water heater provides hot water and hot air. A large amount of hot water can be instantaneously tapped by a hot water generating means, and hot air can be generated by a hot air generating means.

10 Claims, 7 Drawing Sheets

(56) References Cited

U.S. PATENT DOCUMENTS 3,763,849 A * 10/1973 Pfluger ..... F24C 13/00 126/101
4,139,055 A * 2/1979 Thomason ..... F28D 20/0056 165/96
4,640,458 A * 2/1987 Casier ..... F24H 8/00 237/17
4,971,025 A * 11/1990 Mariani ..... F24H 6/00 126/101
8,955,764 B1 * 2/2015 Qanaei ..... F24D 11/009 237/49
9,885,473 B2 * 2/2018 Park ..... F22G 1/16
2003/0123863 A1 * 7/2003 Hughes ..... F24H 9/06 392/449
2003/0198564 A1 * 10/2003 Gatley, Jr. ..... F04D 25/06 417/423.14
2004/0258546 A1 * 12/2004 Gatley, Jr. ..... F04D 25/06 417/423.14
2005/0058560 A1 * 3/2005 Gatley, Jr. ..... F24H 9/02 417/423.14
2007/0028611 A1 * 2/2007 Johnston ..... F02G 1/055 60/520
2012/0125269 A1 * 5/2012 Farrell ..... F24H 8/00 122/18.4
2018/0313577 A1 * 11/2018 Ojiro ..... F23L 5/02
2019/0309990 A1 * 10/2019 Choi ..... F24H 3/08

FOREIGN PATENT DOCUMENTS

KR 10-1676226 B1 11/2016
KR 10-2017-0079861 A 7/2017
KR 10-1758012 B1 7/2017
WO WO-9312389 A1 * 6/1993 ..... F24D 3/087

OTHER PUBLICATIONS

"KR_20050092066_A_H—Machine Translation.pdf", machine translation, EPO.org, May 12, 2020. (Year: 2020).*
"KR_20170079861_A_H—Machine Translation.pdf", machine translation, EPO.org, Nov. 22, 2020. (Year: 2020).*
International Search Report issued in PCT/KR2018/009734; dated Dec. 5, 2018.

* cited by examiner

- PRIOR ART -

STORAGE TYPE ELECTRIC WATER HEATER WITH HOT AIR GENERATING FUNCTION

CROSS-REFERENCE TO RELATED APPLICATIONS

This application is a Continuation of International Application No. PCT/KR2018/009734 filed Aug. 23, 2018, which claims benefit of priority to Korean Patent Application No. 10-2017-0133939 filed Oct. 16, 2017, the entire content of which is incorporated herein by reference.

TECHNICAL FIELD

The present invention relates to a storage type electric water heater with a hot air generating function and, more particularly, to a storage type electric water heater with a hot air generating function, which can supply water at a high temperature and has the hot air generating function to generate hot air.

BACKGROUND ART

Most of water heaters currently on the market have water tanks and store a certain amount of water in the water tanks. This type of water heater has a problem in that water stored in a water tank should be continuously heated, so energy for heating water and unused hot water are wasted.

FIG. 1 is a view showing a conventional electric water heater. Referring to FIG. 1, the conventional electric water heater 1 includes: a storage tank 10 storing water therein; a heater 20 provided in a lower portion of the storage tank 10; a water supply tube 11 provided in a lower side of the storage tank 10; and a tap hole 12 provided in an upper side of the storage tank 10. Water supplied to the storage tank 10 through the water supply tube 11 is directly heated by the heater 20 and then supplied to a user through the tap hole 12.

However, since the conventional electric water heater 1 is a direct heating type that is configured such that the heater 20 directly heats a large amount of water stored in the storage tank 10 and then hot water is supplied to the user, it takes a long time to heat the stored water.

Meanwhile, a bathroom in which the electric water heater is installed often does not have a heating facility. Therefore, during winter, it is necessary to have a separate heating facility like a mobile heater in the bathroom. However, moving the mobile heater every time when the user uses the bathroom is very cumbersome, and the mobile heater makes the bathroom more cramped.

DISCLOSURE

Technical Problem

Accordingly, the present invention has been made keeping in mind the above problems occurring in the prior art, and an object of the present invention is to provide a storage type electric water heater with a hot air generating function, which can instantaneously supply a large amount of water at a high temperature.

Another object of the present invention is to provide a storage type electric water heater with a hot air generating function, wherein, when a user uses hot water, it is possible to reduce cold by using the hot water as a heat source to generate hot air without adding a separate heating facility.

Technical Solution

In order to accomplish the above object, the present invention provides a storage type electric water heater with a hot air generating function includes: an inner housing provided with an inner space for storing water therein; an outer housing surrounding the inner housing while being spaced apart from the inner housing; a hot water generating means having an inlet tube integrally passing through first sides of the inner housing and the outer housing, an outlet tube integrally passing through second sides of the inner housing and the outer housing, a heat exchange tube received in the inner space of the inner housing and having a first end connected to the inlet tube and a second end connected to the outlet tube, and a heater mounted in the inner housing to supply heat to the heat exchange tube; and a hot air generating means having an air intake port provided at a first side of the outer housing, an exhaust port provided at a second side of the outer housing, and an exhaust fan mounted in a separation space between the outer housing and the inner housing.

The inner housing may be made of a heat conductive material, and be configured to transfer heat generated by the heater in the inner space to the separation space.

The outer housing may be provided with a heat insulating portion made of a heat insulating material on an inner surface of the outer housing, and the heat insulating portion may have an intake air guide hole penetrating the heat insulating portion at a position corresponding to the air intake port, and an exhaust air guide hole penetrating the heat insulating portion at a position corresponding to the exhaust port.

The separation space may have a plurality of air guide portions, which protrude from an inside of the outer housing or from an outside of the inner housing and has a first side extending toward the air intake port and a second side extending toward the exhaust port.

The plurality of air guide portions may be arranged in parallel at side portions of the inner housing, and each of the air guide portions is formed in a zigzag shape or a wavy shape.

The inner housing may include: an upper portion; a lower portion located below the upper portion; a front portion located at a front between the upper portion and the lower portion; a rear portion located at a rear of the front portion; and a pair of side portions located at both sides between the front portion and the rear portion, the air intake port may be located to face any one of the upper portion and the lower portion, the exhaust port may be located to face a remaining one of the upper portion and the lower portion, and the air guide portions may protrude from the pair of side portions and extend in directions toward the upper portion and the lower portion.

The heat exchange tube may include: a first coil tube provided in an upper side of the inner space; a second coil tube provided in a lower side of the inner space; a first connection tube connecting the inlet tube and the first coil tube; a second connection tube connecting the first coil tube and the second coil tube; and a third connection tube connecting the second coil tube and the outlet tube, the heater may be located in a center part of the second coil tube.

A diaphragm may be further provided between the first coil tube and the second coil tube.

The diaphragm may be configured to cover an outer circumference of the second coil tube, and to block a flow of water which is stored in the housing and rises due to heat-exchange with the heater or the second coil tube.

The diaphragm may include: a pair of side walls protruding upwardly from a bottom inside the inner housing; and a connecting portion connecting upper sides of the pair of side walls to each other, with the second coil tube and the heater being provided between the pair of side walls.

Advantageous Effects

As described above, according to the present invention, since the heater is provided in the second coil tube, the heater directly heats water flowing through the second coil tube, thereby enabling instantaneous tapping of a large amount of hot water.

In addition, since water moved to the second coil tube firstly increases in temperature by the heater, and secondarily increases in temperature by the hot water between the diaphragm and the second coil tube, the water moved to the second coil tube is tapped at a high temperature that is equal to or higher than 40° C.

In addition, since external cold water does not flow into the inner housing, the temperature of water in the inner housing does not decrease sharply. Since water stored in the inner housing is not periodically replaced, the inside of the inner housing is not contaminated by foreign materials in water.

In addition, since the hot air generating means is provided between the inner housing and the outer housing, air flowing into the separation space is discharged to the outside of the separation space through the exhaust port in a heated state at a high temperature. Accordingly, during winter, the temperature around the outer housing can be increased without using a mobile heater.

In addition, since air moving along the separation space is guided to the exhaust port as slowly as possible while being guided by the air guide portion, air moving along the air guide portion is heat-exchanged with the side portions heated by the heater while being in contact with the side portions for a long period of time, and heat-efficiency can be improved.

| <Description of Reference Numbers> | |
|---|---|
| 100: storage type electric water heater with hot air generating function | |

-continued

| <Description of Reference Numbers> | |
|---|---|
| 110: inner housing | 110a: fist inner housing |
| 110b: second inner housing | 111: inner space |
| 112: upper portion | 113: lower portion |
| 114: front portion | 115: rear portion |
| 116: side portion | 120: outer housing |
| 120a: first outer housing | 120b: second outer housing |
| 122: inlet | 124: outlet |
| 126: drain | 128: drain tube |
| 129: heat insulating portion | 129a: air intake guide hole |
| 129b: exhaust guide hole | 130: separation space |
| 132: air guide portion | 140: hot water generating means |
| 142: inlet tube | 144: outlet tube |
| 146: heat exchange tube | 146a: first coil tube |
| 146b: second coil tube | 146c: first connection tube |
| 146d: second connection tube | 146e: third connection tube |
| 148: heater | 150: diaphragm |
| 152: side wall | 154: connecting portion |
| 160: hot air generating means | 162: air intake port |
| 164: exhaust port | 166: exhaust fan |
| 170: water supply member | 172: float |
| 174: float switch | 176: supply tube |

BEST MODE

Hereinafter, a storage type electric water heater with a hot air generating function according to an exemplary embodiment of the present invention will be described in detail with reference to the accompanying drawings.

Figure 1:
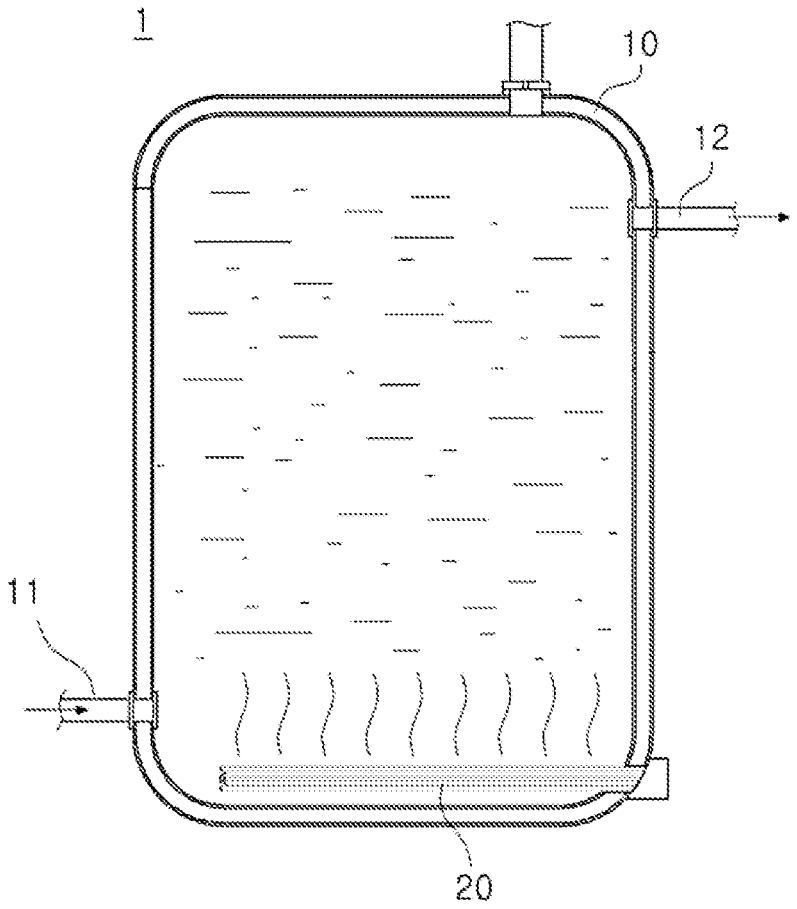
FIG. 1 is a view showing a conventional electric water heater.
Figure 2:
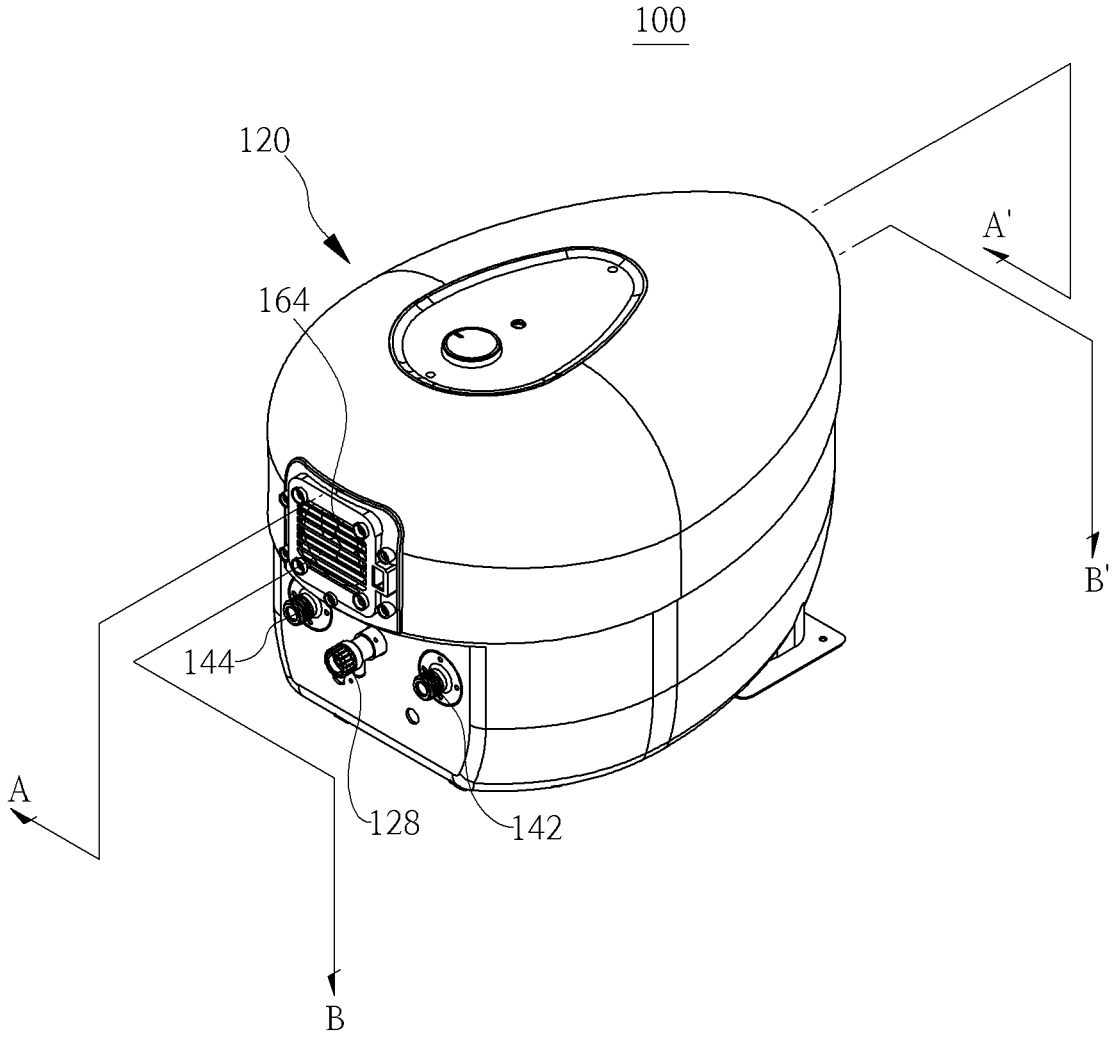
FIG. 2 is a view schematically showing a storage type electric water heater with a hot air generating function according to an exemplary embodiment of the present invention.
Figure 3:
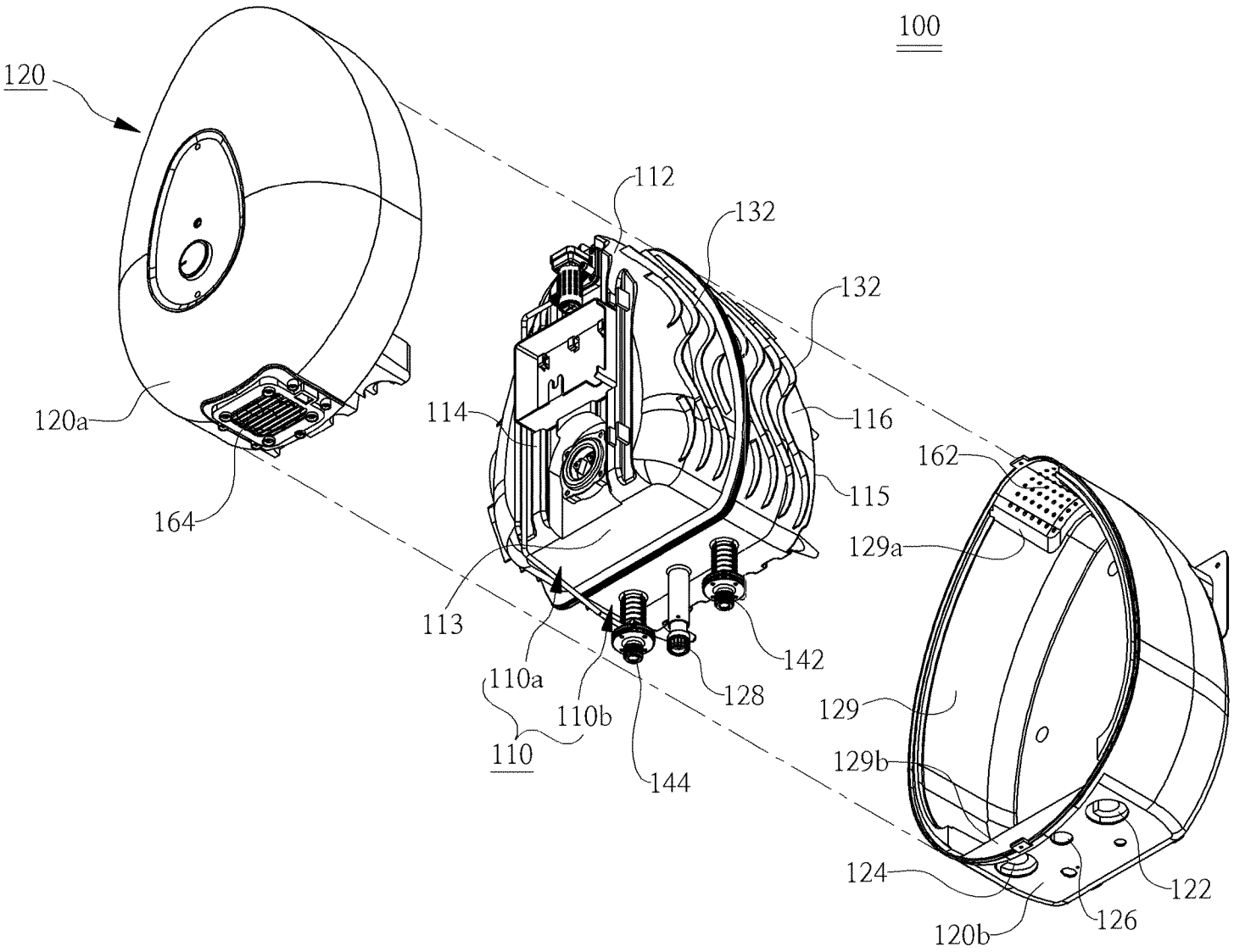
FIG. 3 is an exploded view showing an outer housing of the storage type electric water heater with the hot air generating function according to the present invention.
Figure 4:
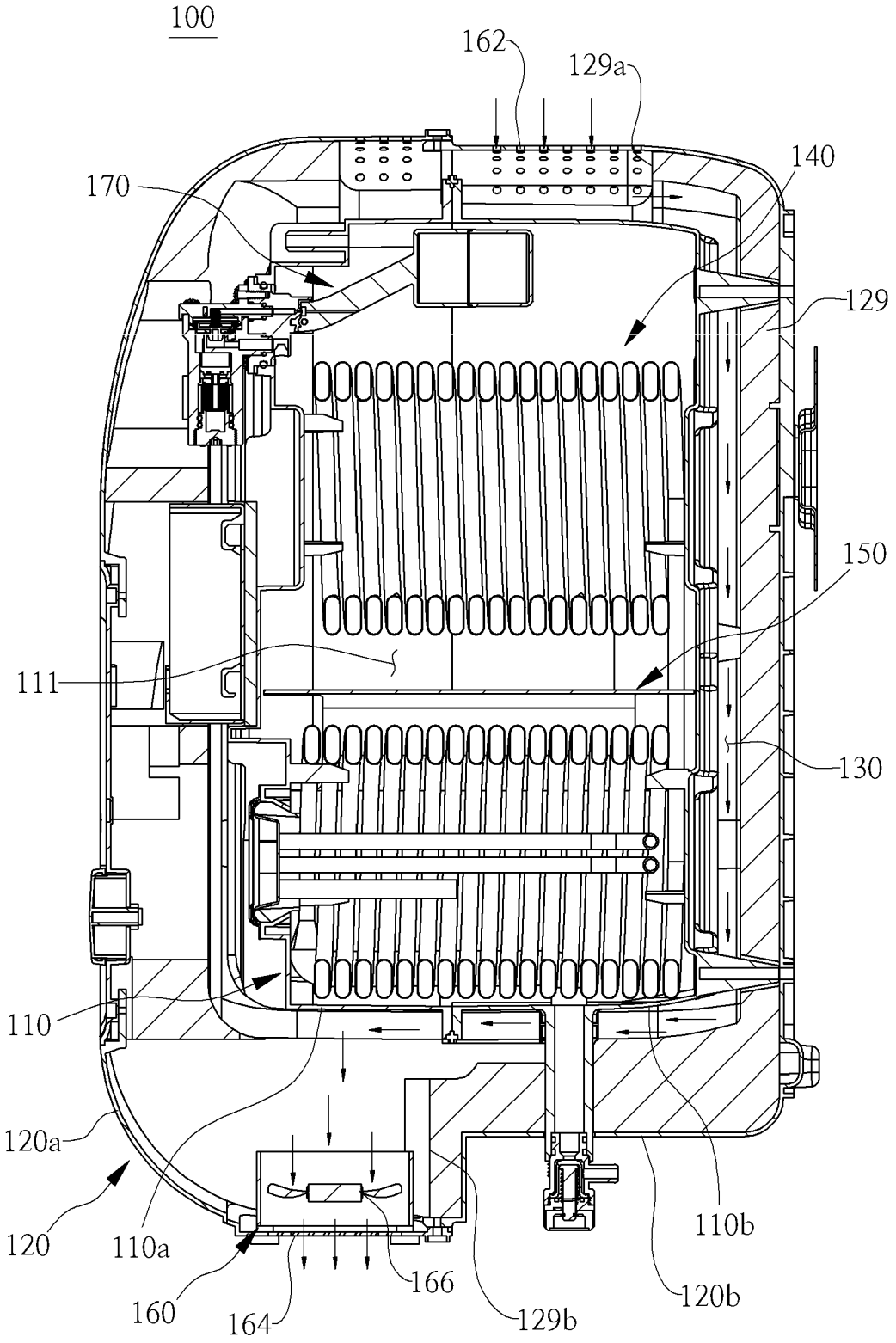
FIG. 4 is a sectional view taken along A-A' line of FIG. 2.

FIG. 2 is a view schematically showing the storage type electric water heater with the hot air generating function according to the exemplary embodiment of the present invention. FIG. 3 is an exploded view showing an outer housing of the storage type electric water heater with the hot air generating function according to the present invention. FIG. 4 is a sectional view taken along A-A' line of FIG. 2.

Referring to FIGS. 2 to 4, the storage type electric water heater 100 with the hot air generating function according to the present invention includes an inner housing 110, an outer housing 120, a hot water generating means 140, and a hot air generating means 160, and may further include a diaphragm 150 and a water supply member 170.

The inner housing 110 is provided with an inner space 111 for storing water therein. The inner housing 110 is configured of a first inner housing 110*a* and a second inner housing 110*b* such that a front inner housing and a rear inner housing are separated from each other on the basis of the inner space 111. That is, when the first inner housing 110*a* and the second inner housing 110*b* are coupled to each other, the inner space 111 is provided therein. Referring to a detailed structure of the inner housing 110, the inner housing 110 includes: an upper portion 112 located at an upper side of the inner housing 110; a lower portion 113 located below the upper portion 112; a front portion 114 located at the front between the upper portion 112 and the lower portion 113; a rear portion 115 located at the rear of the front portion 114; and a pair of side portions 116 located at both sides between the front portion 114 and the rear portion 115. The inner housing 110 is formed of a heat conductive material such as aluminum and copper, and is configured to easily transfer heat generated by a heater 148 in the inner space 111 to a separation space 130. That is, the heater 148 heats water stored in the inner space 111, and hot water stored in the inner space 111 heats the inner housing 110.

Meanwhile, the side portions 116 have an air guide portion 132 of the hot air generating means 160. The air guide portion 132 functions to guide air flowing into the separation space 130 between the inner housing 110 and the outer housing 120 by an exhaust fan 166 to an exhaust port 164. A plurality of air guide portions 132 protrudes from the side portions 116 in parallel, and extends in directions of the upper portion 112 and the lower portion 113. Each of air guide portions 132 is formed in a zigzag shape or a wavy shape so that air moving along the air guide portion 132 is guided to the exhaust port 164 as slowly as possible. Thus, since air moving along the air guide portion 132 is heat-exchanged with the side portions 116 heated by the heater while being in contact with the side portions 116 for a long period of time, heat exchange efficiency is improved.

The outer housing 120 surrounds the inner housing 110 while being spaced apart from the inner housing 110, and the separation space 130 that is an empty space is provided between the outer housing 120 and the inner housing 110. The outer housing 120 is configured of a first outer housing 120*a* and a second outer housing 120*b* such that a front outer housing and a rear outer housing are separated from each other like the inner housing 110. An inlet 122 and an outlet 124 are provided in a first side and a second side of a lower side of the second outer housing 120*b* by penetrating the second outer housing 120*b*, and a drain 126 penetrates the second outer housing 120*b* at a portion between the inlet 122 and the outlet 124. A drain tube 128 passes through the drain 126 in a direction of the inner housing 110 to drain water stored in the inner space 111 to the outside. An air intake port 162 of the hot air generating means 160 penetrates the second outer housing at an upper side of the second outer housing 120*b*, the exhaust port 164 of the hot air generating means 160 penetrates the first outer housing 120*a* at a lower side of the first outer housing 120*a*. Meanwhile, a heat insulating portion 129 may be mounted to cover inner surfaces of first and second outer housings 120*a* and 120*b* facing to each other and the separation space 130. The heat insulating portion 129 is formed of a heat insulating material such as synthetic resin with excellent heat blocking performance, and functions to prevent external cold air from passing through the first and second outer housings 120*a* and 120*b* into the separation space 130. The heat insulating portion 129 has an air intake guide hole 129*a* penetrating the heat insulating portion 129 at a position corresponding to the air intake port 162 so that external air flows into the separation space 130 through the air intake port 162. In addition, the heat insulating portion 129 has an exhaust guide hole 129*b* penetrating the heat insulating portion 129 at a position corresponding to the exhaust port 164 so that air in the separation space 130 is discharged through the exhaust port 164.

The hot water generating means 140 includes an inlet tube 142, an outlet tube 144, a heat exchange tube 146, and the heater 148. The inlet tube 142 integrally-passes through first sides of the inlet 122 and the inner housing 110, and is configured of a first side located at the inner space 111 and a second side located below the outer housing 120. The outlet tube 144 integrally-passes through second sides of the outlet 124 and the inner housing 110, and is configured of a first side located at the inner space 111 and a second side located below the outer housing 120. The inlet tube 142 allows external water to flow into the housing, and the outlet tube 144 allows hot water passing through a second coil tube 146*b* to be discharged to the outside of the outer housing 120. The heat exchange tube 146, the heater 148, the diaphragm 150, and the water supply member 170 will be described with reference to FIG. 5.

The hot air generating means 160 includes the air intake port 162, the exhaust port 164, and the exhaust fan 166. The air intake port 162 and the exhaust port 164 are provided in the outer housing 120 as described above. The exhaust fan 166 is a general configuration including a fan operated by a motor. The exhaust fan 166 is mounted in a position corresponding to the exhaust port 164 of the separation space 130 to allow external air to flow into the separation space 130 through the air intake port 162, and to allow air flowing into the separation space 130 to be discharged through the exhaust port 164. Operation of the hot air generating means 160 will be described with reference to FIG. 7.

Figure 5:
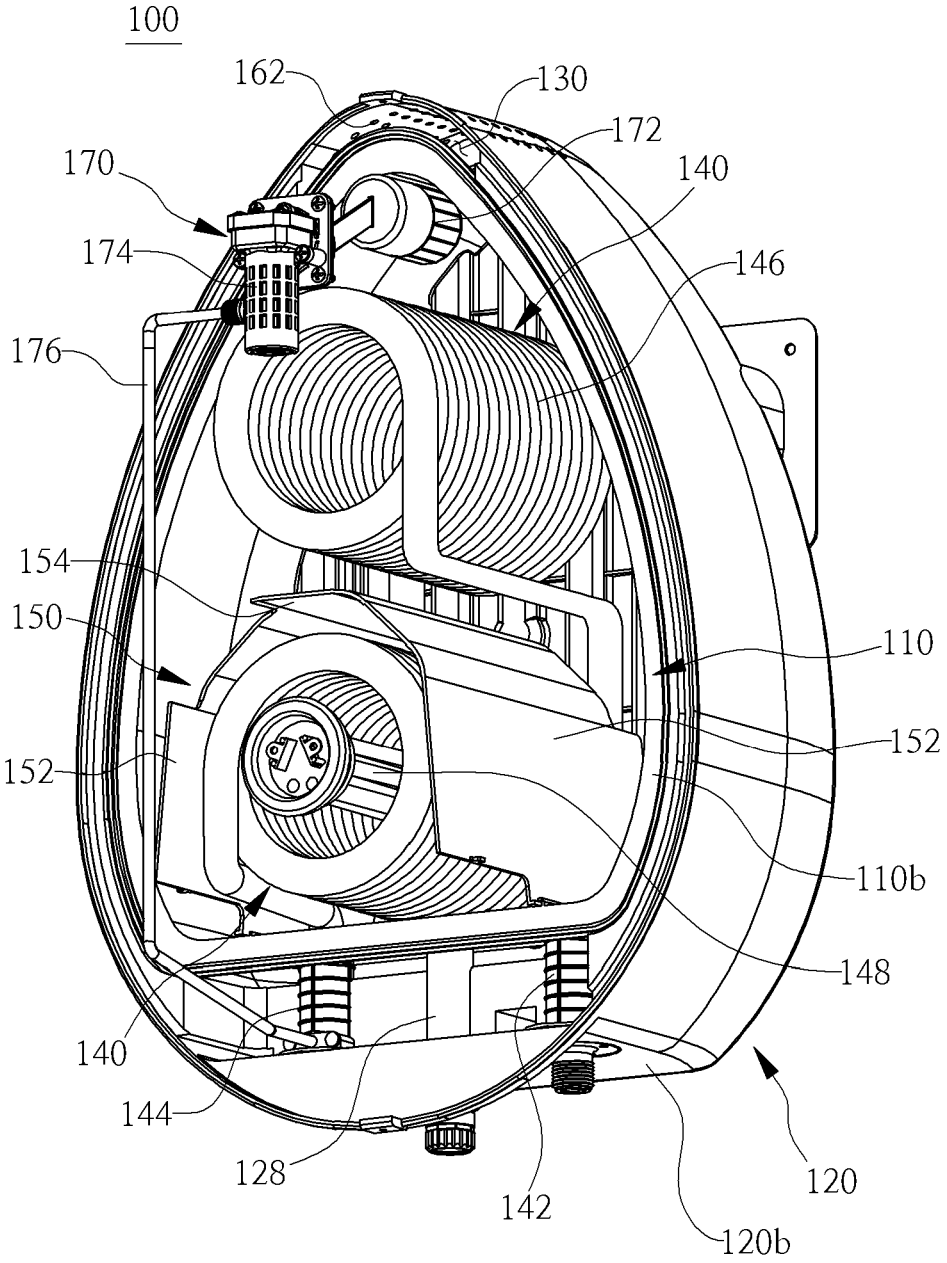
FIG. 5 is a view schematically showing the inside of the storage type electric water heater with the hot air generating function according to the present invention.
Figure 6:
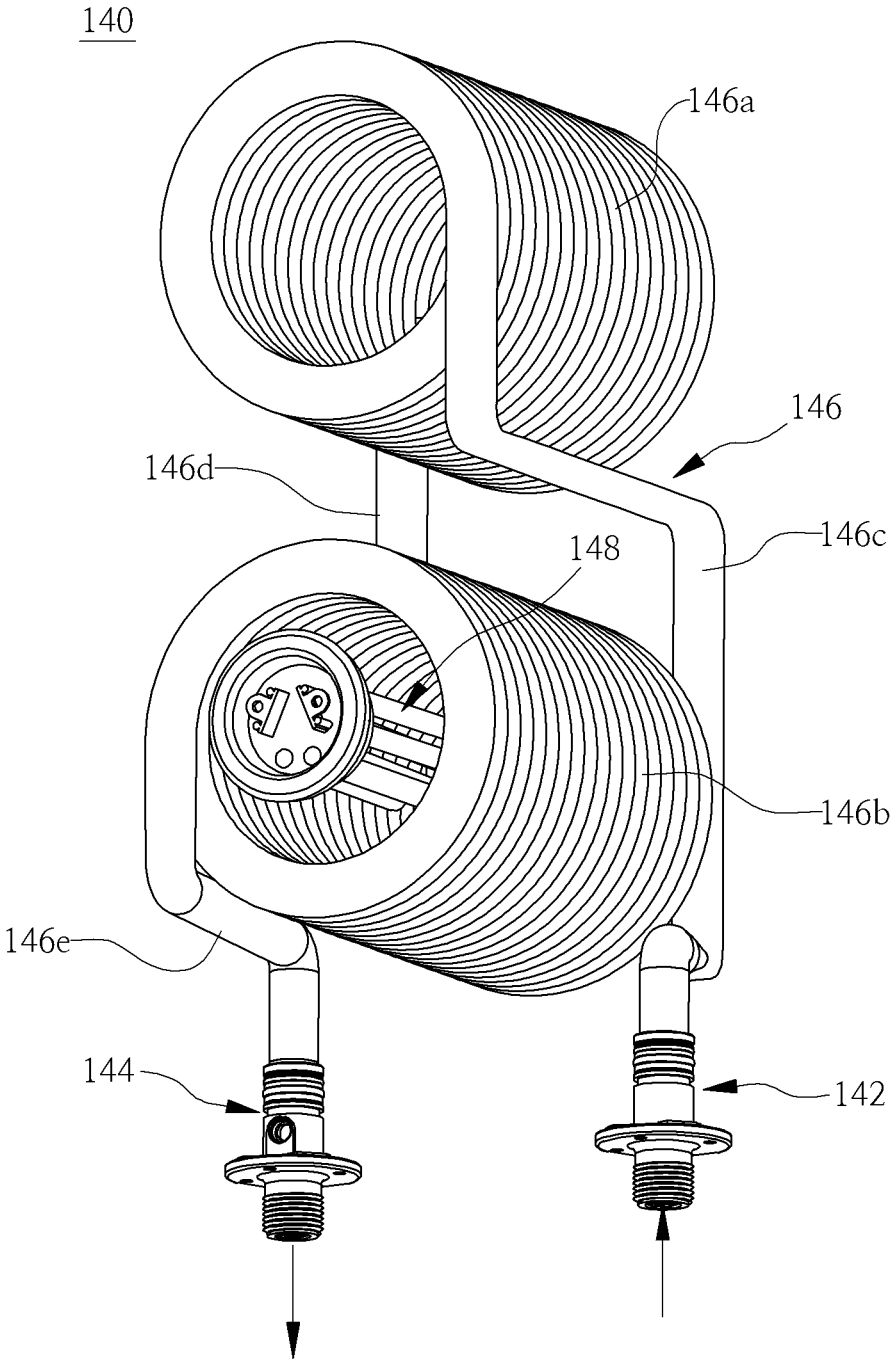
FIG. 6 is a view schematically showing a hot water generating means of the storage type electric water heater with the hot air generating function according to the present invention.

FIG. 5 is a view schematically showing the inside of the storage type electric water heater with the hot air generating function according to the present invention. FIG. 6 is a view schematically showing the hot water generating means of the storage type electric water heater with the hot air generating function according to the present invention.

Referring to FIGS. 5 to 6, the hot water generating means 140 includes the inlet tube 142, the outlet tube 144, the heat exchange tube 146, and the heater 148. The heat exchange tube 146 includes: a first coil tube 146*a* provided in an upper side of the inner space 111; the second coil tube 146*b* provided in a lower side of the inner space 111; a first connection tube 146*c* connecting the inlet 122 and the first coil tube 146*a*; a second connection tube 146*d* connecting the first coil tube 146*a* and the second coil tube 146*b*; a third connection tube 146*e* connecting the second coil tube 146*b* and the outlet 124. The first coil tube 146*a* is located at the upper side of the inner space 111, the second coil tube 146*b* may be located at the lower side of the inner space 111 to be spaced apart downwardly from the first coil tube 146*a*. The first and second coil tubes 146*a* and 146*b* are formed by winding a pipe into a coil form. Since the heat-exchange area of the coil form with water stored in the inner space 111 is large, heat exchange efficiency is improved. The heater 148 heats the first coil tube 146*a* or the second coil tube 146*b*, for example, the heater 148 is configured to radiate heat by electricity. The heater 148 may be located at the center of the second coil tube 146*b* to supply heat to the second coil tube 146*b*. In addition, a temperature sensor (not shown) may be provided in the third connection tube 146*e* or the outlet tube 144, and a power switch (not shown) may be further provided to turn ON/OFF power of the heater 148 depending on the temperature measured by the temperature sensor.

Meanwhile, in the embodiment of the present invention, the first coil tube 146*a* is configured as one, but the present invention is not limited thereto. In some cases, the first coil tube 146*a* may be configured as a plurality of interconnected coil tubes.

The diaphragm 150 is provided between the first coil tube 146*a* and the second coil tube 146*b*, and is configured to cover an outer circumference of the second coil tube 146*b*. The diaphragm 150 protrudes upward from an inner bottom of the inner housing 110, and includes a pair of side walls 152 between which the second coil tube 146*b* and the heater 148 are provided, and a connecting portion 154 connecting upper sides of the pair of side walls 152 to each other. The side walls 152 and the connecting portion 154 are formed in a plate shape, and the second coil tube 146*b* and the heater 148 are provided in a space formed by the side walls 152 and the connecting portion 154. Thus, a flow of water which is stored in the inner space 111 of the inner housing 110 and rises due to heat-exchange with the heater 148 or the second coil tube 146*b* is blocked by the diaphragm 150, so the temperature of water located below the diaphragm 150 is higher than the temperature of water located around the first coil tube 146*a*.

The water supply member 170 controls a level of water stored in the inner space 111 of the inner housing 110 to be constant. The water supply member 170 includes a float 172 installed to ascend or descend by the level of water stored in the inner space 111, a float switch 174 coupled to the float 172 by a hinge and regulating supply of water depending on a position of the float 172, and a supply tube 176 supplying water to the float switch 174. The float 172 is configured to float above a water surface of water stored in the inner space 111 by buoyancy in the water. The supply tube 176 is connected to the inlet 122 and supplies water flowing into the inner housing 110 to the float switch 174. When the float 172 ascends above a predetermined height of the inner space 111, the float switch 174 blocks water in the supply tube 176 from being supplied to the inner space 111, and when the float 172 descends below the predetermined height of the inner space 111, the float switch 174 allows water in the supply tube 176 to be supplied to the inner space 111. Accordingly, the level of water stored in the inner space 111 by the water supply member 170 remains constant.

Hereinafter, the operation of the storage type electric water heater with the hot air generating function according to the exemplary embodiment of the present invention will be described.

Figure 7:
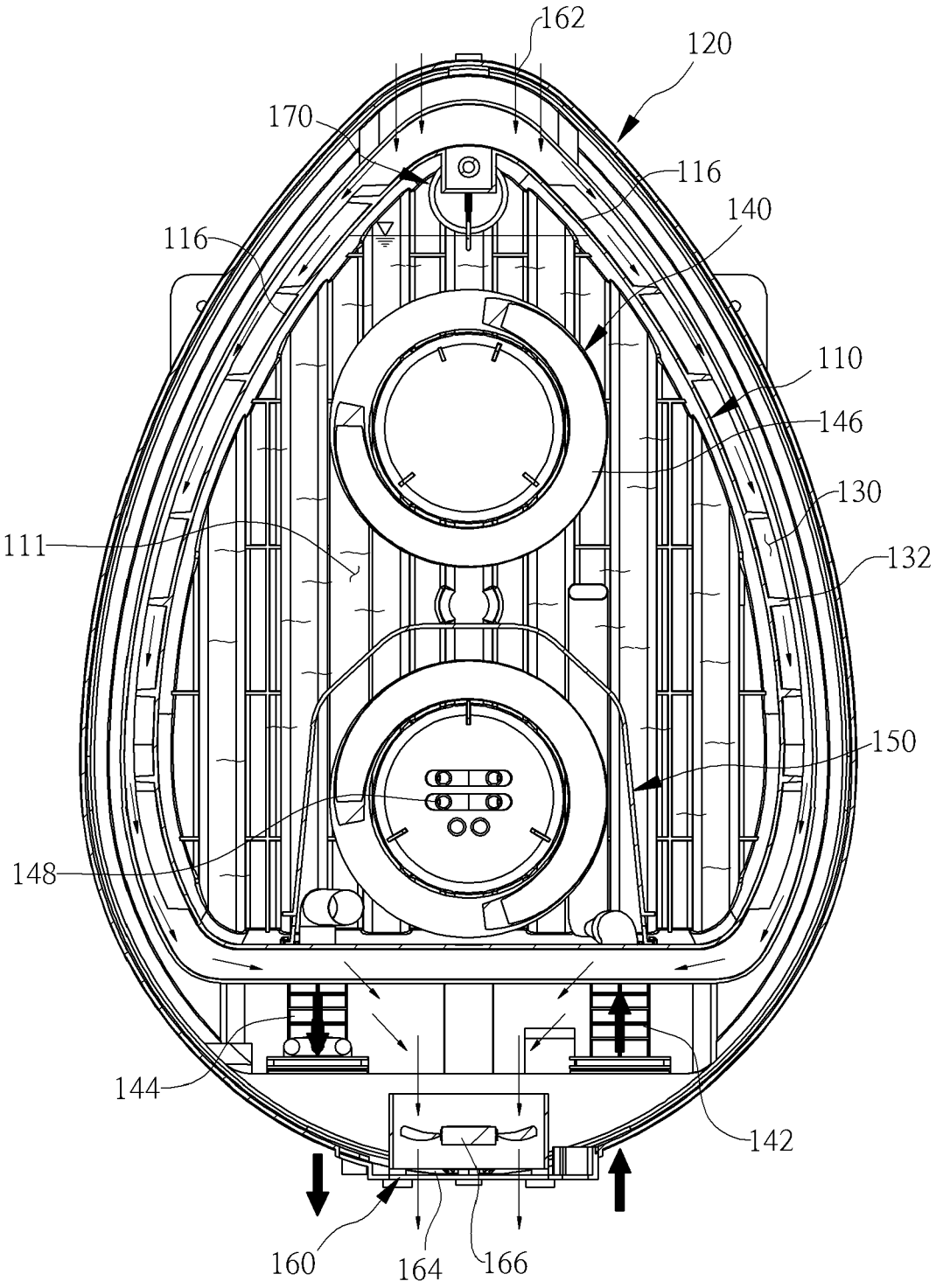
FIG. 7 is a sectional view taken along B-B' line of FIG. 2.

FIG. 7 is a sectional view taken along B-B' line of FIG. 2.

Referring to FIGS. 2 to 7, external water, such as direct receiving type tap water, flowing into the inner space 111 of the inner housing 110 through the inlet passes through the first connection tube 146*c* and moves to the first coil tube 146*a*. Here, the inner space 111 of the inner housing 110 contains water, and water in the inner space 111 has a higher temperature than the temperature of the tap water by the heater 148. Accordingly, water in the first coil tube 146*a* firstly increases in temperature by being heat-exchanged with water in the inner space 111 of the inner housing 110.

Then, water moved along the first coil tube 146*a* passes through the second connection tube 146*d* and moves to the second coil tube 146*b*. Since the second coil tube 146*b* is provided with the heater 148, water moved to the second coil tube 146*b* secondarily increases in the temperature by being heat-exchanged with the heater 148. Since the diaphragm 150 is provided in the outside of the second coil tube 146*b*, the flow of water which is stored in the inner housing 110 and rises due to heat-exchange with the heater 148 or the second coil tube 146*b* is blocked by the diaphragm 150. Therefore, heat of hot water between the diaphragm 150 and the second coil tube 146*b* is not transferred to the upper side of the inner housing 110 and the hot water is heat-exchanged with the second coil tube 146*b*, so water moving along the second coil tube 146*b* increases in temperature.

That is, water moved to the second coil tube 146*b* increases in temperature by the heater 148, and further increases in temperature by the hot water between the diaphragm 150 and the second coil tube 146*b*. Accordingly, the water moved to the second coil tube 146*b* is tapped at a high temperature that is equal to or higher than 40° C.

In addition, since water flowing into the inner housing 110 through the inlet 122 becomes hot water while passing through the first and second coil tubes 146*a* and 146*b*, it is possible to instantaneously tap a large amount of hot water without directly heating a large amount of water in the inner housing 110.

In addition, since external cold water does not flow into the inner housing 110, the temperature of water in the inner housing 110 cannot decrease sharply, and since water stored in the inner housing 110 is not periodically replaced, the inside of the inner housing 110 cannot be contaminated by foreign materials in water.

Meanwhile, when the exhaust fan 166 is operated, external air flows into the separation space 130 through the air intake port 162, and air flowing into the separation space 130 is discharged through the exhaust port 164. Since the inner housing 110 is heated by water stored in the inner space 111, air flowing into the separation space 130 is heat-exchanged with the inner housing 110 and becomes hot air, and is discharged through the exhaust port 164.

Since the electric water heater of the present invention is provided with the hot air generating means 160, air flowing into the separation space 130 can be discharged to the outside of the separation space 130 through the exhaust port 164 in a heated state at a high temperature. In addition, since air moving along the separation space 130 is guided to the exhaust port 164 as slowly as possible while being guided by the air guide portion 132, air moving along the air guide portion 132 is heat-exchanged with the side portions 116 heated by the heater 148 while being in contact with the side portions 116 for a long period of time, and heat-exchange efficiency is improved Although a preferred embodiment of the present invention has been described for illustrative purposes, those skilled in the art will appreciate that various modifications, additions and substitutions are possible, without departing from the scope and spirit of the invention as disclosed in the accompanying claims.

The invention claimed is:

1. A storage type electric water heater with a hot air generating function, the electric water heater comprising:

an inner housing provided with an inner space for storing water therein;

an outer housing surrounding the inner housing while being spaced apart from the inner housing;

a hot water generating means having an inlet tube integrally passing through first sides of the inner housing and the outer housing, an outlet tube integrally passing through second sides of the inner housing and the outer housing, a heat exchange tube received in the inner space of the inner housing and having a first end connected to the inlet tube and a second end connected to the outlet tube, and a heater mounted in the inner housing to supply heat to the heat exchange tube; and a hot air generating means having an air intake port provided at a first side of the outer housing, an exhaust port provided at a second side of the outer housing, and an exhaust fan mounted in a separation space between the outer housing and the inner housing.

2. The electric water heater of claim 1, wherein the inner housing is made of a heat conductive material, and is configured to transfer heat generated by the heater in the inner space to the separation space.

3. The electric water heater of claim 1, wherein the outer housing is provided with a heat insulating portion made of a heat insulating material on an inner surface of the outer housing, and the heat insulating portion has an intake air guide hole penetrating the heat insulating portion at a position corresponding to the air intake port, and an exhaust air guide hole penetrating the heat insulating portion at a position corresponding to the exhaust port.

4. The electric water heater of claim 1, wherein the separation space has a plurality of air guide portions, which protrude from an inside of the outer housing or from an outside of the inner housing and has a first side extending toward the air intake port and a second side extending toward the exhaust port.

5. The electric water heater of claim 4, wherein the plurality of air guide portions is arranged in parallel at side portions of the inner housing, and each of the air guide portions is formed in a zigzag shape or a wavy shape.

6. The electric water heater of claim 5, wherein the inner housing comprises: an upper portion; a lower portion located below the upper portion; a front portion located at a front between the upper portion and the lower portion; a rear portion located at a rear of the front portion; and a pair of side portions located at both sides between the front portion and the rear portion, the air intake port is located to face any one of the upper portion and the lower portion, the exhaust port is located to face a remaining one of the upper portion and the lower portion, and the air guide portions protrude from the pair of side portions and extend in directions toward the upper portion and the lower portion.

7. The electric water heater of claim 1, wherein the heat exchange tube comprises: a first coil tube provided in an upper side of the inner space; a second coil tube provided in a lower side of the inner space; a first connection tube connecting the inlet tube and the first coil tube; a second connection tube connecting the first coil tube and the second coil tube; and a third connection tube connecting the second coil tube and the outlet tube, the heater is located in a center part of the second coil tube.

8. The electric water heater of claim 7, wherein the heat exchange tube further comprises: a diaphragm between the first coil tube and the second coil tube.

9. The electric water heater of claim 8, wherein the diaphragm is configured to cover an outer circumference of the second coil tube, and to block a flow of water which is stored in the housing and rises due to heat-exchange with the heater or the second coil tube.

10. The electric water heater of claim 9, wherein the diaphragm comprises: a pair of side walls protruding upwardly from a bottom inside the inner housing; and a connecting portion connecting upper sides of the pair of side walls to each other, with the second coil tube and the heater being provided between the pair of side walls.

* * * * *